US011247353B2

(12) United States Patent
Phoon et al.

(10) Patent No.: US 11,247,353 B2
(45) Date of Patent: Feb. 15, 2022

(54) ATTACHMENT COMB AND HAIR CUTTING APPLIANCE

(71) Applicant: KONINKLIJKE PHILIPS N.V., Eindhoven (NL)

(72) Inventors: Kin Fatt Phoon, Dratchen (NL); Jens Andersson, Amsterdam (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/143,230

(22) Filed: Jan. 7, 2021

(65) Prior Publication Data

US 2021/0129362 A1 May 6, 2021

Related U.S. Application Data

(63) Continuation-in-part of application No. 15/124,160, filed as application No. PCT/EP2016/052101 on Feb. 2, 2016, now Pat. No. 10,913,170.

(30) Foreign Application Priority Data

Feb. 26, 2015 (EP) ..... 15156723

(51) Int. Cl.
*B26B 19/20* (2006.01)
*B26B 19/38* (2006.01)
*B26B 19/06* (2006.01)

(52) U.S. Cl.
CPC ..... *B26B 19/20* (2013.01); *B26B 19/063* (2013.01); *B26B 19/3813* (2013.01)

(58) Field of Classification Search
CPC .... B26B 19/20; B26B 19/063; B26B 19/3813
See application file for complete search history.

(56) References Cited

U.S. PATENT DOCUMENTS 2,608,756 A 9/1952 Ivar
2,718,696 A 9/1955 Green
(Continued)

FOREIGN PATENT DOCUMENTS

CN 204019564 12/2014
EP 2332700 6/2011
(Continued)

*Primary Examiner* — Ghassem Alie
*Assistant Examiner* — Fernando A Ayala

(57) ABSTRACT

The present disclosure relates to a releasable attachment comb for a blade set of a cutting head of a hair cutting appliance, said attachment comb comprising a supporting frame comprising a first lateral grip bar, a second lateral grip bar, and at least one laterally extending supporting bar arranged between the first lateral grip bar and the second lateral grip bar, a plurality of guide teeth that define a skin contact front face; a plurality of snap-on mounting elements; wherein the snap-on mounting elements are spaced away from the first lateral grip bar and the second lateral grip bar; wherein at least one of the snap-on mounting elements is configured as a proximal snap-on mounting element that is arranged on a first, proximal side; wherein at least one of the snap-on mounting elements is configured as a distal snap-on mounting element that is arranged on a second, distal side; and wherein the at least one proximal snap-on mounting element and the at least one distal snap-on mounting element are arranged to mutually lock therebetween the blade set to attach the attachment comb to the cutting head. The present disclosure further relates to a cutting head of a hair cutting appliance that is fitted with a respective attachment comb.

20 Claims, 6 Drawing Sheets

(56) References Cited

U.S. PATENT DOCUMENTS

| | | | | |
|---|---|---|---|---|
| 2,878,563 | A | 3/1959 | Schmoyer | |
| 3,008,233 | A | 11/1961 | Waggoner | |
| 3,149,418 | A | 9/1964 | Milbourne | |
| 3,334,416 | A | 8/1967 | Green | |
| 3,648,370 | A | 3/1972 | Cercone | |
| 4,493,154 | A * | 1/1985 | Pascual | B26B 19/22 30/233.5 |
| 5,050,305 | A * | 9/1991 | Baker | B26B 19/20 30/201 |
| 5,937,526 | A * | 8/1999 | Wahl | B26B 19/20 30/201 |
| 5,937,527 | A | 8/1999 | Okada | |
| 5,979,060 | A | 11/1999 | Holzbauer | |
| 6,079,103 | A | 6/2000 | Melton | |
| 8,815,072 | B2 | 8/2014 | Watanabe | |
| 9,149,418 | B2 | 10/2015 | Desenne et al. | |
| 9,833,914 | B2 * | 12/2017 | Sobagaki | B26B 19/205 |
| 2002/0092178 | A1 | 7/2002 | Fung | |
| 2003/0229988 | A1 | 12/2003 | Jennings | |
| 2003/0233754 | A1 * | 12/2003 | Braun | B26B 19/20 30/201 |
| 2004/0006873 | A1 | 1/2004 | Cutting | |
| 2004/0250428 | A1 * | 12/2004 | Melton | B26B 19/3813 30/200 |
| 2005/0138817 | A1 * | 6/2005 | Yamaguchi | B26B 19/20 30/233 |
| 2006/0042095 | A1 * | 3/2006 | Yamaguchi | B26B 19/3853 30/201 |
| 2008/0263869 | A1 | 10/2008 | Floessholzer | |
| 2008/0295340 | A1 | 12/2008 | Carlucci | |
| 2009/0113722 | A1 | 5/2009 | Werner | |
| 2012/0233865 | A1 | 9/2012 | Kammer | |
| 2014/0215832 | A1 * | 8/2014 | Julemont | A45D 24/36 30/200 |
| 2014/0331504 | A1 | 11/2014 | Michel | |

FOREIGN PATENT DOCUMENTS

| | | |
|---|---|---|
| JP | 2010227268 | 10/2010 |
| RU | 2490117 | 8/2013 |
| WO | 2006103589 | 10/2006 |
| WO | 2013150412 | 10/2013 |

* cited by examiner

ATTACHMENT COMB AND HAIR CUTTING APPLIANCE

CROSS REFERENCE TO RELATED APPLICATIONS

This is a Continuation application which claims the benefit of U.S. patent application Ser. No. 15/124,160 filed Sep. 7, 2016, which is the U.S. National Phase application under 35 U.S.C. § 371 of International Application No. PCT/EP2016/052101, filed Feb. 2, 2016 which claims the benefit of European Patent Application Number 15156723.7 filed Feb. 26, 2015. These applications are hereby incorporated by reference herein.

FIELD OF THE INVENTION

The present disclosure relates to an attachment comb for a blade set of a cutting head of a hair cutting appliance, particularly for a pivotably supported blade set. The present disclosure further relates to a cutting head for a hair cutting appliance and to a hair cutting appliance that can be fitted with an attachment comb. More particularly, the present disclosure relates to a hair cutting appliance that is operable in a hair-trimming mode and in a shaving mode.

BACKGROUND OF THE INVENTION

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that prevents hair from being cut off close to the skin. Consequently, a user desiring to both shave and trim his/her body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles some of these issues by providing a blade set comprising a stationary blade that houses the movable blade such that a first portion of the stationary blade is arranged at the side of the movable blade facing the skin, when used for shaving, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows longer hairs to enter the slots and, consequently, to be cut by the relative cutting motion between the movable blade and the stationary blade.

U.S. Pat. No. 3,008,233 A discloses a hair trimmer attachment for detachable securement to the shaving head of an electric razor, said attachment including a pair of longitudinally extending ribs spaced at a distance to accommodate a shaving head therebetween, and a plurality of transversely extending teeth formed integrally with said ribs and located above the ribs, said teeth having an interior shape to conform to the shape of the shaving head of said electric razor so as to assure a close fit of the attachment with the head.

US 2012/233865 A1 discloses an adjustable comb assembly attachable to an electric hair cutting appliance, the comb assembly comprising a plurality of teeth for regulating a haircut length resulting from the hair being cut by the cutting edge of the electric hair cutting appliance, wherein when the adjustable comb assembly is attached to the electric hair cutting appliance, the teeth are selectively movable relative to the cutting edge of the electric hair cutting appliance to any one of a substantially infinite number of different haircut length positions.

US 2002/092178 A1 discloses a hair clipper comprising a housing, a rotating blade assembly removably connected to said housing, said blade assembly having two cutting edges and a single cutting plane, said blade assembly being adapted to selectively rotate about an axis substantially normal to said cutting plane, and a switch mechanism being operatively connected to said blade assembly for selectively unlocking said blade assembly thereby enabling said blade assembly to be rotated about said axis.

US 2014/0215832 A1 discloses a removable comb that is intended to be attached onto a hair or beard clipper, the comb comprising a latch allowing, in use, to attach said comb onto a clipper, said latch being positioned on an arc, the curvature of which increases when pressure is applied on the sides of the arc, wherein the increase of the curvature on the arc causes the comb to unlock.

A comb as disclosed in US 2014/0215832 A1 may be reliably attached to and removed from a housing of a hair clipping apparatus. The latch of said comb which is to some extent deflectable, can be biased by the user of said apparatus. However, to engage and disengage the comb, the user needs to exert a considerable level of force to the sides of the comb. In principle, such an arrangement is well-suited for a direct attachment of the comb to a rigid housing of the hair clipper.

However, hair cutting appliances are known which utilize blade sets that are attached thereto in a hinged or pivotable manner. In other words, the blade set may swivel with respect to the housing of the hair cutting appliance so as to align with a currently processed skin contour. This may significantly increase the shaving capability of the hair cutting appliance. In case it is desired to maintain the swiveling or pivoting capability of the blade set when a comb is attached thereto, account should be taken of retaining forces, actuation forces and further implications that may arise from a direct attachment of the comb.

Consequently, there is still a need for improvement in hair cutting appliances. This may particularly involve user comfort related aspects and performance related aspects. Particularly with hair cutting appliances comprising blade sets that are pivotably attached to the housing, operating the appliance in different distinct operation modes may pose several challenges. Particularly reliably spacing the blade set of such an appliance from a user's skin may be difficult.

SUMMARY OF THE INVENTION

It is on object of the present disclosure to provide an attachment comb that is arranged for trimming operations and that can be attached to and detached from a blade set of a hair cutting appliance. More preferably, in case the hair cutting appliance provides a contour-following capability, the attachment comb should be directly attachable to the blade set such that the blade set and the comb attached thereto still can be pivoted or swiveled with respect to the hair cutting appliance so as to align with the currently to-be-processed skin contour. Advantageously, the present disclosure may address at least some drawbacks inherent in known prior art cutting appliances as discussed above. It is further preferred to provide a cutting head for a hair cutting appliance and a hair cutting appliance that are arranged and well-suited for both shaving operations and trimming operations. It is particularly preferred that the attachment comb enhances the trimming performance of the hair cutting appliance.

In a first aspect of the present disclosure a releasable attachment comb for a blade set of a cutting head of a hair cutting appliance, particularly for a pivotably supported blade set, is presented, said attachment comb comprising:

a supporting frame comprising, at respective opposite lateral ends thereof, a first lateral grip bar and a second lateral grip bar that are arranged to be grasped by a user, and at least one laterally extending supporting bar arranged between the first lateral grip bar and the second lateral grip bar;

a plurality of guide teeth that define a skin contact front face; and a plurality of snap-on mounting elements, particularly a plurality of snap-on hooks;

wherein the snap-on mounting elements are spaced away from the first lateral grip bar and the second lateral grip bar;

wherein at least one of the snap-on mounting elements is configured as a proximal snap-on mounting element that is arranged on a first, proximal side;

wherein at least one of the snap-on mounting elements is configured as a distal snap-on mounting element that is arranged on a second, distal side that is opposite to the first side; and wherein the at least one proximal snap-on mounting element and the at least one distal snap-on mounting element are arranged to mutually lock therebetween the blade set to attach the attachment comb to the cutting head.

This aspect is based on the insight that the provision of the attachment comb, particularly the act of mounting and/or removing the attachment comb, may be significantly simplified when handling zones, particularly contact zones, where the user may grasp the attachment comb are arranged as separate entities that are preferably distinct or remote from any snap-on mounting element that eventually engages the blade set and locks the attachment comb thereon. In other words, the snap-on mounting elements may be referred to as self-actuated or self-actuating snap-on elements that are—so to say—self-actuated or automatically actuated when the attachment comb approaches and engages the blade set. In other words, the user merely mediately operates the snap-on mounting elements by approaching the blade set with the attachment comb. Hence, the act of mounting the attachment comb merely requires to slip or push the attachment comb on the blade set.

By contrast, the above US 2014/0215832 A1 teaches to bias the latch of the removable comb by applying pressure on the sides of an arc where said latch is positioned so as to engage or disengage said latch. This may be regarded as an appropriate measure for mounting the removable comb on a fixed housing of a hair-clipping appliance. However, in case it is desired to maintain the contour-following capability of the hair cutting appliance even when the comb is attached thereto, any actuation force and/or engagement force the attachment comb applies on the hair cutting appliance is exerted on the blade set itself.

Consequently, as the blade set is basically attached and received in a movable fashion with respect to the housing of the hair cutting appliance, any force that may be generated in the course of the mounting process should be limited. By splitting or separating the spots where the user actually contacts the attachment comb and the location of the snap-on mounting elements which eventually engage the blade set and lock the attachment comb onto the blade set it may be ensured that the engagement force and/or any strain that is attributable to the engagement force may be limited.

More particularly, an influence or impact of an actuation force applied by the user to the lateral grip bars on the engagement force can be limited and/or lowered to a tolerable level as the user actuation force is not directly converted into the engagement force.

Moreover, in accordance with the above aspect, the attachment comb can make profit of the fact that the user typically tends to grasp and actuate the attachment comb at lateral sides or ends thereof. This is mainly because the user typically attempts to avoid contacting the attachment comb at the longitudinal sides thereof that are associated with the toothed leading edge of the cutting head.

It is worth mentioning in this context that the attachment comb preferably may be mounted to hair cutting appliances that utilize blade sets that are arranged as dual-purpose or multi-purpose blade sets that are suited for both trimming and shaving operations.

In an exemplary embodiment of the attachment comb, the first lateral grip bar and the second lateral grip bar are provided with a respective indication that prompts the user to grasp and engage the attachment comb. In the alternative or in addition, the first lateral grip bar and the second lateral grip bar are provided with a respective depression or recess to indicate intended force application spots. Hence, a clear assignment of actuation positions and an unambiguous mounting/detachment action of the attachment comb can be achieved.

In an exemplary embodiment, the attachment comb is arranged to be directly attached to the blade set. Hence, the attachment comb may be arranged to be mediately attached to any housing portion of the appliance of the cutting head thereof. Consequently, at least on some embodiments implementing a pivotably supported contour following blade set, the blade set and the attachment comb attached thereto may be moved with respect to the housing in a swiveling fashion.

Preferably, a first pair of mounting elements and a second pair of mounting elements is provided, each of which is composed of a proximal snap-on mounting element and a respective distal snap-on mounting element that are facing each other. Preferably, each of the first pair and the second pair of snap-mounting elements comprises a proximal snap-on mounting element and a distal snap-on mounting element that are aligned with each other in the lateral direction. Preferably, the first pair of snap-on mounting elements is associated with the first lateral end and the second pair of snap-on mounting element is associated with the second lateral end of the attachment comb. This may of course include that the respective snap-on mounting elements are spaced at a distance from the respective first lateral grip bar and the second lateral grip bar. In other words, it is preferred that an actuation (i.e. exertion of a push force) of the first lateral grip bar and the second lateral grip bar does not directly cause a respective actuation of the snap-on mounting elements. Conversely, it is preferred that the snap-on mounting elements may be actuated or deflected independently of an actuation of the lateral grip bars. When the attachment comb approaches and contacts the blade set, the snap-on mounting elements may be actuated and deflected by the act of putting or pulling the attachment comb on the blade set.

In one embodiment, at least one of the proximal snap-on mounting element or the distal snap-on mounting element, preferably each snap-on mounting element, is attached to the supporting frame in a deflectable fashion and deformable when the attachment comb approaches the blade set in a mounting direction and engages the blade set. To this end, a living hinge or, at least, a deflectable portion may be provided at a transition zone between the supporting frame and the respective snap-on mounting element.

Preferably, the mounting direction or, so to say, the intended (ideal) mounting direction is basically linear. In other words, the user may attach or detach the attachment comb by simply grasping it at the lateral grip bars and by approaching and engaging the blade set in a basically linear motion until the snap-on elements lock the attachment comb on the blade set. Consequently, attaching and detaching the attachment comb can be further simplified as no combined mounting motion is required. For instance, some conventional attachments combs may require a multi-dimensional mounting motion, for instance a combination of a linear approach motion and a rotating and/or swiveling engagement motion to respectively approach a blade set and to lock the attachment comb thereto. In accordance with the above embodiment, operating the engagement comb is further facilitated which also reduces the risk of maloperation.

As indicated above, an engagement deflection of the snap-on mounting element basically occurs independent of an actual level of a user's actuation force and/or grip force. The deflection of the snap-on mounting elements is primarily induced or caused by the mounting movement as such. Consequently, a rather simple motion-related mounting operation may mediately cause the required engagement and retaining force.

In accordance with anther embodiment of the attachment comb, at least one of the proximal snap-on mounting element or the distal snap-on mounting element, preferably each snap-on mounting element, is deformed in a self-deflecting fashion when the attachment comb is imposed on the blade set, and is deformed in a self-deflecting fashion when the attachment comb is removed from the blade set. That is, the snap-on mounting elements may be indirectly operated by actuating or grasping the attachment comb and by applying a mounting force (or a removal force) to the first lateral grip bar and the second lateral grip bar. Preferably, the proximal snap-on mounting elements deflect in a deflection direction that is opposed to the deflection direction of the distal snap-on mounting element. Furthermore, the deflection directions of the snap-on mounting elements are preferably substantially perpendicular to a direction of the push force the user may apply to the first lateral grip bar and the second lateral grip bar.

In yet another embodiment of the attachment comb, the snap-on mounting elements, when engaging the blade set, urge the attachment comb into a defined position and orientation with respect to the blade set. Preferably, in a further refinement of the attachment comb, the snap-on mounting elements, when engaging the blade set, retain the attachment comb in a force fit and positive locking fashion thereon. Consequently, the attachment comb may be secured at the blade set without significant play. Preferably, the attachment comb is at least slightly biased in the mounted state. This may increase the cutting performance and may reduce any rattling and/or running noise.

In still another embodiment of the attachment comb, the snap-on mounting elements are arranged remote from the first lateral grip bar and the second lateral grip bar, wherein the at least one proximal snap-on mounting element is, in a mounted state, associated with a toothed leading edge of the blade set. Consequently, the snap-on mounting elements may engage the blade set at or adjacent to the respective toothed leading edge. Hence, the attachment comb may be accurately oriented and positioned at the blade set. This may significantly increase the cutting performance. As indicated above, the user does not have to apply an actuation force that directly acts on the toothed leading edge. Rather, the actuating push force applied by the user to the lateral ends of the attachment comb is primarily sustained by the receiving frame of the attachment comb.

In a further refinement of the above embodiment, the at least one proximal snap-on mounting element comprises a retaining portion, particularly a retaining protrusion, that engages, in the mounted state, a stationary blade of the blade set in the vicinity of the toothed leading edge. Preferably, the retaining portion engages the stationary blade in a direction that is perpendicular to the longitudinal extension of the toothed leading edge and engages the stationary blade at respective lateral ends of the toothed leading edge adjacent to, but not at, the lateral grip bars. Preferably, the at least one proximal snap-on mounting element and the at least one distal snap-on mounting element define, when viewed in the mounting direction, a narrowing zone and, following the narrowing zone, a seating or receiving zone. In other words, the attachment comb may be provided with a pull-in guiding geometry that facilitates the mounting process. Preferably, the attachment comb is self-aligning when approaching the blade set.

In still another refinement of the above embodiment, the at least one proximal snap-on mounting element is, in the mounted state, associated with a first toothed leading edge of the blade set, wherein the at least one distal snap-on mounting element, is, in the mounted state, associated with a second toothed leading edge of the blade set, and wherein the at least one distal snap-on mounting element comprises a retaining portion, particularly a retaining protrusion, that engages, in the mounted state, the stationary blade of the blade set in the vicinity of the second toothed leading edge. Consequently, each pair of distal and proximal snap-on mounting elements may bias or lock the blade set therebetween. Respective biasing forces or locking forces are applied to the blade set in a direction that is basically perpendicular to the longitudinal direction.

Preferably, the proximal snap-on mounting elements and the distal snap-on mounting element engage the stationary blade of the blade set at reinforced lateral end portions of the respective longitudinal extension thereof. Assuming that a first pair of snap-on mounting elements and a second pair of snap-on mounting elements is provided, the teeth of the toothed leading edge of the blade set may be arranged between the contact spots of the two pairs.

In yet another embodiment of the attachment comb, the guide teeth further define a receiving seat for the blade set that is facing away from the skin contact front face. Furthermore, the front face and the receiving seat may be arranged at a desired space and angle therebetween. Consequently, in the mounted state of the attachment comb, the blade set may be oriented in a desired fashion with respect to the to-be-processed skin portion.

In another embodiment of the attachment comb, the at least one proximal snap-mounting element is formed at a respective mounting tooth that is provided with a weakening recess. Generally, the attachment comb may comprise a series of teeth that are basically arranged in a parallel fashion. At least some of the teeth may be arranged as guide teeth. At least one tooth that may be arranged at a lateral end of the attachment comb may be provided with a weakening recess or space so as to increase the flexibility and/or deflection behavior of the at least one proximal snap-on mounting element. Preferably, two mounting teeth are provided at respective lateral ends of the series of teeth.

In accordance with another embodiment of the attachment comb, the at least one distal snap-on mounting element is arranged as a snap-on hook at a rear supporting bar of the receiving frame. To this end, a recess or slot may be formed in the rear supporting bar so as to provide a respective weakening to increase the flexibility and/or deflection behavior of the at least one distal snap-on mounting element.

In still another embodiment of the attachment comb, the receiving frame is further arranged to cover, in the mounted state, a second toothed leading edge of the blade set that is arranged opposite to a first toothed leading edge of the blade set. As a consequence, the attachment comb may clearly indicate the toothed leading edge that is to be used for the desired hair trimming operation. It may be further preferred in this context that the attachment comb is arranged as a reversible attachment comb that can be mounted to the blade set in two orientations so as to selectively block or deactivate a first toothed leading edge or a second toothed leading edge of the blade set. In other words, in accordance with this refinement, the attachment comb may be mounted in a first, forward orientation and a second, rearward orientation. This may enable further cutting operations at hard-to-reach skin areas.

Preferably, the attachment comb is arranged as an integrally formed single-piece injection-molded part. Preferably, the attachment comb is made from resilient plastic material. For instance, the attachment comb may be formed from plastic material that is reinforced, particularly from fiber-reinforced plastics.

In a further aspect of the present disclosure a cutting head for a hair cutting appliance, particularly for an electrically operated grooming appliance, is presented, the cutting head comprising:

a blade set comprising a stationary blade and a cutter blade, the stationary blade and the cutter blade comprising at least one toothed leading edge jointly defined by respective teeth of the stationary blade and the cutter blade, the teeth of the stationary blade and the cutter blade basically extending in a longitudinal direction, wherein the stationary blade further comprises a front face, particularly at the teeth thereof, the front face being arranged to face a user's skin, when in operation; and an attachment comb in accordance with at least some embodiments of the present disclosure;

wherein the attachment comb is releasably mounted to the blade set and arranged to position the blade set at a defined distance from and orientation with respect to a user's skin, when in operation.

In accordance with this embodiment, the cutting head is particularly suited for shaving operations, when the attachment comb is removed from the blade set. In the attached state, when the attachment comb engages the blade set, the cutting head is particularly suited for hair trimming operations.

In one embodiment of the cutting head, the cutting head further comprises a swiveling mechanism that couples the blade set and a housing portion, wherein the attachment comb is arranged, in the mounted state, to be pivoted along with the blade set with respect to the housing portion. In other words, the attachment comb can be attached to the blade set independently of the housing portion. Consequently, assuming that a contour-following feature is provided by the swiveling mechanism for the blade set, the contour-following capability is also enabled when the attachment comb is mounted thereon. In other words, the attachment comb is, in accordance with this embodiment, not directly attached to the housing but rather mediately coupled to the housing via the cutting head and the swiveling mechanism.

In a further embodiment of the cutting head, the blade set is releasably attached to a housing portion, wherein the at least one proximal snap-on mounting element and the at least one distal snap-on mounting element are arranged such that a required release force for removal of the attachment comb from the blade set is smaller than a required release force for removal of the blade set from the housing portion.

This is particularly beneficial since the attachment comb may be mounted and removed in a defined and explicit fashion. Put differently, in case the release force required for removing the attachment comb from the blade set is greater than the release force that is required to remove the blade set from the housing portion, the user would quite often accidentally detach the blade set from the housing portion before eventually disengaging the attachment comb from the blade set. It is again emphasized in this connection that preferably the attachment comb is not directly connected to the housing portion. As the user's actuation force applied to the first lateral grip bar and to the second lateral grip bar of the attachment comb is not directly transferred into a release force, the risk of overstraining is greatly reduced. Furthermore, by, so to say, disconnecting or separating the level of the user's push force from the level of the engagement force and disengagement force induced by the respective engagement and/or disengagement movement, the level of the engagement/disengagement force may be accurately defined. This may further increase the operational reliability of the attachment comb.

In yet another aspect of the present disclosure, a hair cutting appliance is presented, particularly an electrically operated grooming appliance, the hair cutting appliance being arranged to be moved through hair in a moving direction to cut hair, wherein the hair cutting appliance comprises a blade set, particularly a pivotably mounted blade set, and an attachment comb in accordance with at least some aspects of the present disclosure. Preferably, the hair cutting appliance is operable to shave hair in a shaving mode, when the attachment comb is detached from the hair cutting appliance, and operable to trim hair in a trimming mode, when the attachment comb is mounted thereto, wherein preferably the blade set is in both the shaving mode and the trimming mode configured to swivel such that the blade set can be adapted to and/or aligned with a working surface, particularly a user's skin. Consequently, in both operation modes, a contour-following capability may be present.

In still another aspect of the present disclosure, a set of attachment combs may be provided that are arranged in accordance with at least some aspects of the present disclosure, particularly in terms of their mounting features, and that provide distinct defined orientations and/or relative positions between the blade set and the to-be-processed skin surface so as to enable trimming operations at different lengths.

BRIEF DESCRIPTION OF THE DRAWINGS

These and other aspects of the disclosure will be apparent from and elucidated with reference to the embodiments described hereinafter. In the following drawings.

DETAILED DESCRIPTION OF THE EMBODIMENTS

Figure 1:
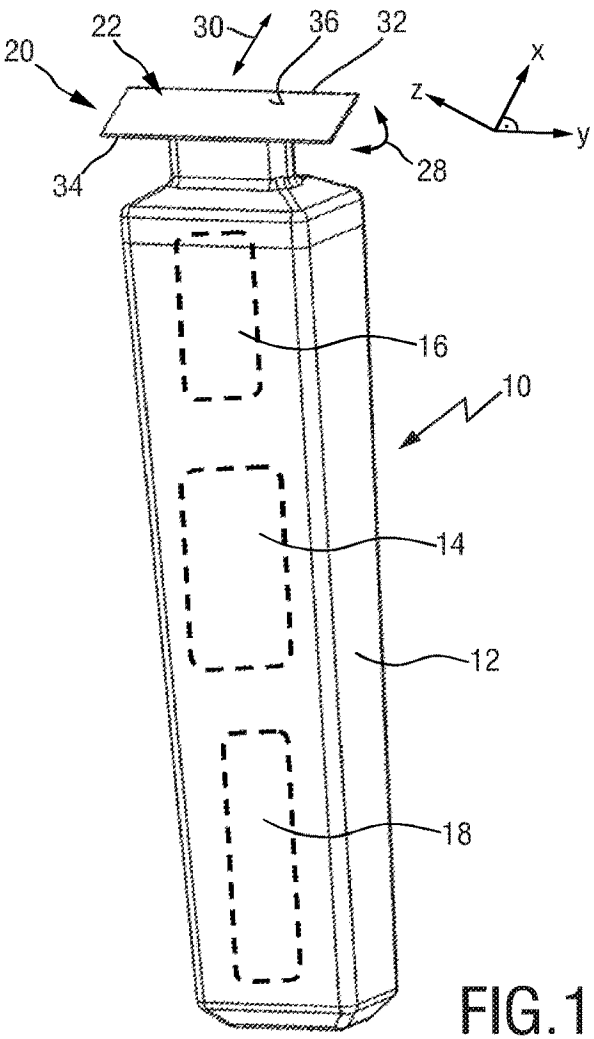
FIG. 1 shows a schematic perspective view of an exemplary hair cutting appliance that may be fitted with an exemplary embodiment of an attachment comb in accordance with the present disclosure.

FIG. 1 schematically illustrates, in a simplified perspective view, an exemplary embodiment of the hair cutting appliance 10, particularly an electric hair cutting appliance. The hair cutting appliance 10 may comprise a housing or, more particularly, a housing portion 12, a motor indicated by a dashed block 14 in the housing portion 12, and a drive mechanism or drive train indicated by a dashed block 16 in the housing portion 12. For powering the motor 14, at least in some embodiments of the hair cutting appliance 10, an electrical battery, indicated by a dashed block 18 in the housing portion 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 18.

The hair cutting appliance 10 may further comprise a cutting head 20. At the cutting head 20, a blade set 22 may be attached to the hair cutting appliance 10. The blade set 22 may be driven by the motor 14 via the drive mechanism or drive train 16 to enable a cutting motion. The cutting motion may generally be regarded as a relative motion between a stationary blade and a movable cutter blade which will be further described and discussed hereinafter. Generally, a user may grasp, hold and manually guide cutting appliance 10 through hair in a moving direction 30 to cut hair. The cutting appliance 10 may be generally regarded as a hand-guided or hand-operated electrically powered device. Furthermore, the cutting head 20 or, more particularly, the blade set 22 can be connected to the housing portion 12 of the cutting appliance 10 in a pivotable manner, refer to the curved double-arrow indicated by reference numeral 28 in FIG. 1. In some applications, the cutting appliance 10 can be moved along skin to cut hair growing at the skin. When cutting hair closely to the skin, basically a shaving operation can be performed aiming at cutting or chopping hair at the level of the skin. However, also clipping (or trimming) operations may be envisaged, wherein the cutting head 20 comprising the blade set 22 is passed along a path at a desired distance relative to the skin.

When being guided through hair, the cutting appliance 10 including the blade set 22 is typically moved along a common moving direction which is indicated by the reference numeral 30 in FIG. 1. It is worth mentioning in this connection that, given that the hair cutting appliance 10 is typically manually guided and moved, the moving direction 30 thus not necessarily has to be construed as a precise geometric reference having a fixed definition and relation with respect to the orientation of the hair cutting appliance 10 and its cutting head 20. That is, an overall orientation of the hair cutting appliance 10 with respect to the to-be-cut hair at the skin may be construed as somewhat unsteady. However, for illustrative purposes, it may be fairly assumed that the (imaginary) moving direction 30 is parallel (or generally parallel) to a main central plane of a coordinate system which may serve in a following as a means for describing structural feature of the hair cutting appliance 10.

For ease of reference, coordinate systems are indicated in several drawings herein. By way of example, a Cartesian coordinate system X-Y-Z is indicated in FIG. 1. An axis X of the respective coordinate system extends in a generally longitudinal direction that is generally associated with length, for the purpose of this disclosure. An axis Y of the coordinate system extends in a lateral (or transverse) direction associated with width, for the purpose of this disclosure. An axis Z of the coordinate system extends in a height (or vertical) direction which may be referred to for illustrative purposes, at least in some embodiments, as a generally vertical direction. It goes without saying that an association of the coordinate system X-Y-Z to characteristic features and/or embodiment of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including alternative orientations. It is further worth mentioning that, for the purpose of the present disclosure, the coordinate system X-Y-Z is generally aligned with main directions and orientations of the cutting head 20, particularly of the blade set 22 thereof.

Figure 2:
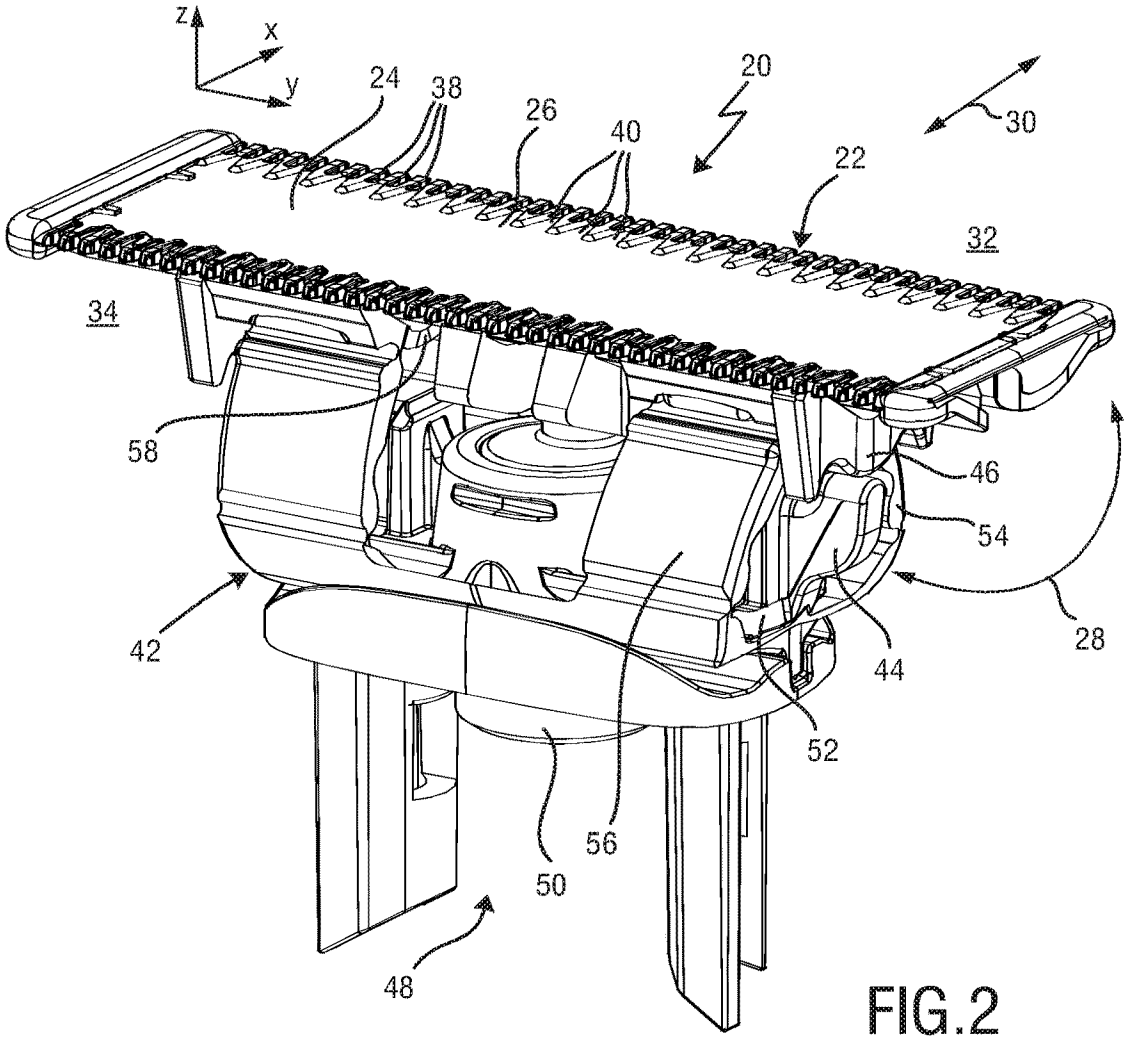
FIG. 2 shows a perspective top view of a blade set of a cutting head for a hair cutting appliance.

FIG. 2 shows a perspective top view of a blade set 22 that may be implemented in the cutting head 20 illustrated in FIG. 1. The blade set 22 comprises a stationary blade 24 and a cutter blade 26 that may be moved with respect to the stationary blade 24 in a reciprocating motion. The stationary blade 24 and the cutter blade 26 may jointly define at least one toothed leading edge 32, 34, preferably a first toothed leading edge 32 and a second toothed leading edge 34. The first toothed leading edge 32 and the second toothed leading edge 34 are arranged in parallel fashion and facing away from each other. The movable cutter blade 26 is indicated in FIG. 2 in a dashed representation. The cutter blade 24 may be driven by a drive shaft 50 in a reciprocating manner. Consequently, the cutter blade 26 and the stationary blade 24 may be reciprocatingly moved with respect to each other and therefore cooperate to cut hairs that enter slots between teeth 38 of the stationary blade 24 and teeth 40 of the cutter blade 26 at the respective leading edges 32, 34 when the hair cutting appliance 10 is moved through hair in the moving direction 30.

The stationary blade 24 may be arranged as a guard for the movable cutter blade 26. It is particularly preferred that the stationary blade 24 comprises a first wall portion and a secondary wall portion which are at least partially spaced from each other such that a guide slot for the cutter blade 26 is defined therebetween, refer also to the cross-sectional representations of the blade set 22 in FIGS. 9, 10 and 11. As a consequence, the stationary blade 24 may also cover the cutter blade 26 at the at least one toothed leading edge 32, 34.

As already indicated above, the blade set 22 may be particularly suited for shaving and trimming operations. Shaving performance and trimming performance may be further improved when the blade set 22 is capable of following an actual skin contour. Consequently, it is particularly preferred that the blade set 22 is attachable to the housing portion 12 of the hair cutting appliance 10 in a pivotable fashion. A swiveling mechanism is indicated in FIG. 2 by reference numeral 42. The blade set 22 is attached to the swiveling mechanism 42. The swiveling mechanism 42 may form a part of the cutting head 20 that is interposed between the blade set 22 and the housing portion 12. The swiveling mechanism 42 may define a pivot or, rather, a virtual pivot for the blade set 22, refer to the curved double-arrow 28 in FIGS. 1 and 2.

So as to define a maximum swiveling angle of the blade set 22 with respect to the housing portion 12, the swiveling mechanism 42 may comprise a limit stop 44 that may cooperate with a contact surface 46 to define an allowed range of the swiveling motion. By way of example, the swiveling mechanism 42 may be arranged as a four-bar-linkage mechanism. In this embodiment, the swiveling mechanism 42 comprises a base link 52 that may be attached to the housing portion 12. A first side link 54 and a second side link 56 may be coupled to the base link 52. At a top end thereof, the swiveling mechanism 42 may comprise a top link 58 that connects the first side link 54 and the second side link 56. Between the respective links 52, 54, 56, 58 hinges may be provided, particularly living hinges, that enable relative rotation between neighboring links and thus the overall pivoting motion.

Generally, at least in some embodiments, the cutting head 20 may be regarded as a replaceable and/or a detachable cutting head. To this end, the cutting 20 may comprise an attachment interface 48 which is arranged to engage a respective receiving interface at the housing portion 12 of the hair cutting appliance 10. Particularly, the cutting head 20 may be arranged as a plug-in cutting head 20. As already indicated above, the blade set 22, particularly the cutter blade 26 thereof, may be coupled to the drive shaft 50. The drive shaft 50 may comprise an eccentric portion that may revolve about a longitudinal axis of the drive shaft 50. Consequently, an eccentric drive mechanism 16 may be provided for driving the cutter blade 26 in a reciprocating fashion with respect to the stationary blade 24.

Being fitted with the swiveling mechanism 42 as exemplarily illustrated in FIG. 2 or with another exemplary embodiment of a swiveling mechanism, the cutting head 20 may be particularly suited for shaving operations. However, it is further preferred that the hair cutting appliance 10 is also suited for hair trimming operations. Hair trimming may involve cutting hairs at a desired length. The desired remaining length of the hairs may be defined by a so-called attachment comb. When attaching the attachment comb to the hair cutting appliance 10, it has to be considered that the blade set 22 is preferably pivotably mounted at the housing portion 12. At least in some embodiments as discussed herein, it is preferred that the contour-following feature is provided also in the trimming mode when the attachment comb is mounted to the blade set 22. Consequently, in contrast to prior art devices as for instance disclosed in US 2014/0215832 A1, it is preferred not to directly attach the attachment comb to the housing portion 12 which—in return—would lock or block the swiveling mechanism 42.

Figure 3:
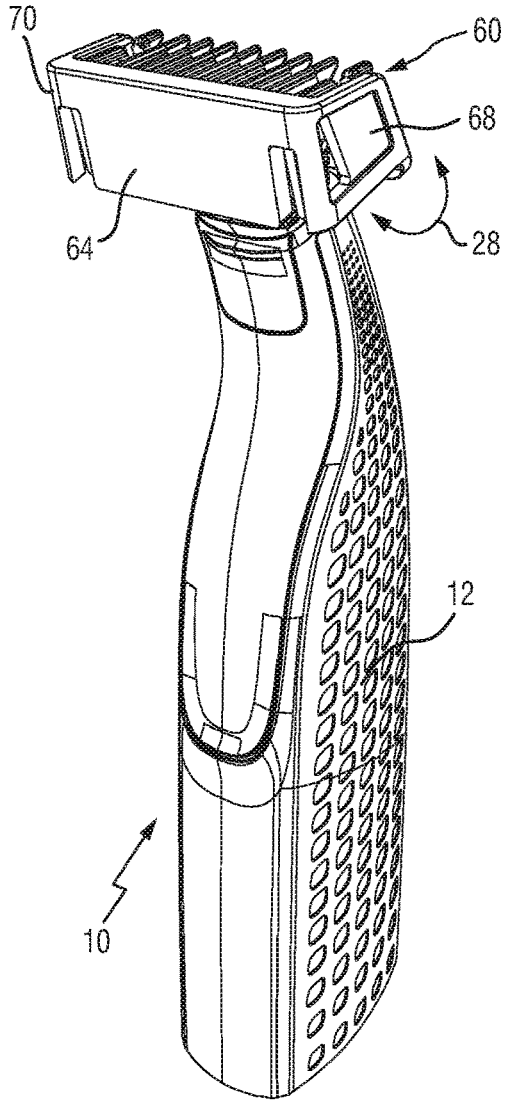
FIG. 3 shows a perspective view of another exemplary embodiment of a hair cutting appliance that is fitted with an embodiment of an attachment comb in accordance with the present disclosure.
Figure 4:
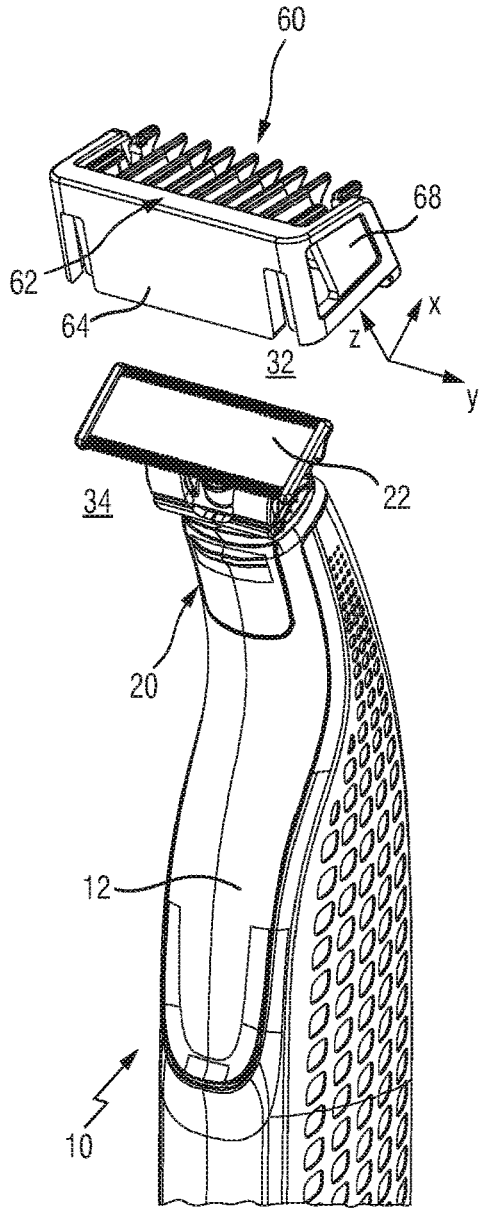
FIG. 4 shows a further partial perspective view of the arrangement shown in FIG. 3, wherein the attachment comb is shown in a detached state.

With particular reference to FIGS. 3 to 11, an exemplary embodiment of an attachment comb 60 for a hair cutting appliance 10 will be illustrated and further described in more detail. The attachment comb 60 is shown in FIG. 3 in a mounted state. In contrast, the attachment comb 60 is shown in FIG. 4 in a detached state. FIG. 3 and FIG. 4 illustrate an exemplary embodiment of a housing portion 12 of a hair cutting appliance 10. The housing portion 12 is shaped in a basically elongated fashion. However, along its overall longitudinal extension, the housing portion 12 is at least slightly curved or banana-shaped. As a consequence, as can be seen in FIG. 4, a main orientation of a respective blade set 22 is somewhat deviated or tilted with respect to a handle portion or grip portion of the housing portion 12 which is typically arranged at an end thereof that is opposite to the cutting head 20.

The cutting head 20 and particularly the blade set 22 and the swiveling mechanism 42 may be basically arranged in accordance with the embodiment described above in accordance with FIG. 2. Preferably, the attachment comb 60 is directly attached to the blade set 22. Furthermore, the attachment comb 60 is preferably not directly attached to the housing portion 12. As a consequence, also the attachment comb 60 may be pivoted by the swiveling mechanism 42 with respect to the housing portion 12, refer also to the pivoting arrow 28 in FIG. 3. Consequently, the contour-following capability of the hair cutting appliance 10 is also maintained when the hair cutting appliance 10 is in the hair trimming mode.

However, this arrangement poses several challenges to the mounting and/or attachment process and to respective mounting features of the attachment comb 60. It has to be considered that the blade set 22 is a relatively small-sized and, to some extent, fragile unit. As a consequence, the attachment comb 60 is particularly adapted to the intended direct mounting to the blade set 22. Furthermore, as already indicated above, the blade set 22 and/or the cutting head 20 including the blade set 22 and the swiveling mechanism 42 may be attached to the housing portion 12 in a releasable fashion. It should be therefore considered that detaching the attachment comb 60 does not, by accident, also detach the blade set 20 or the swiveling mechanism 42 from the hair cutting appliance 10.

Figure 5:
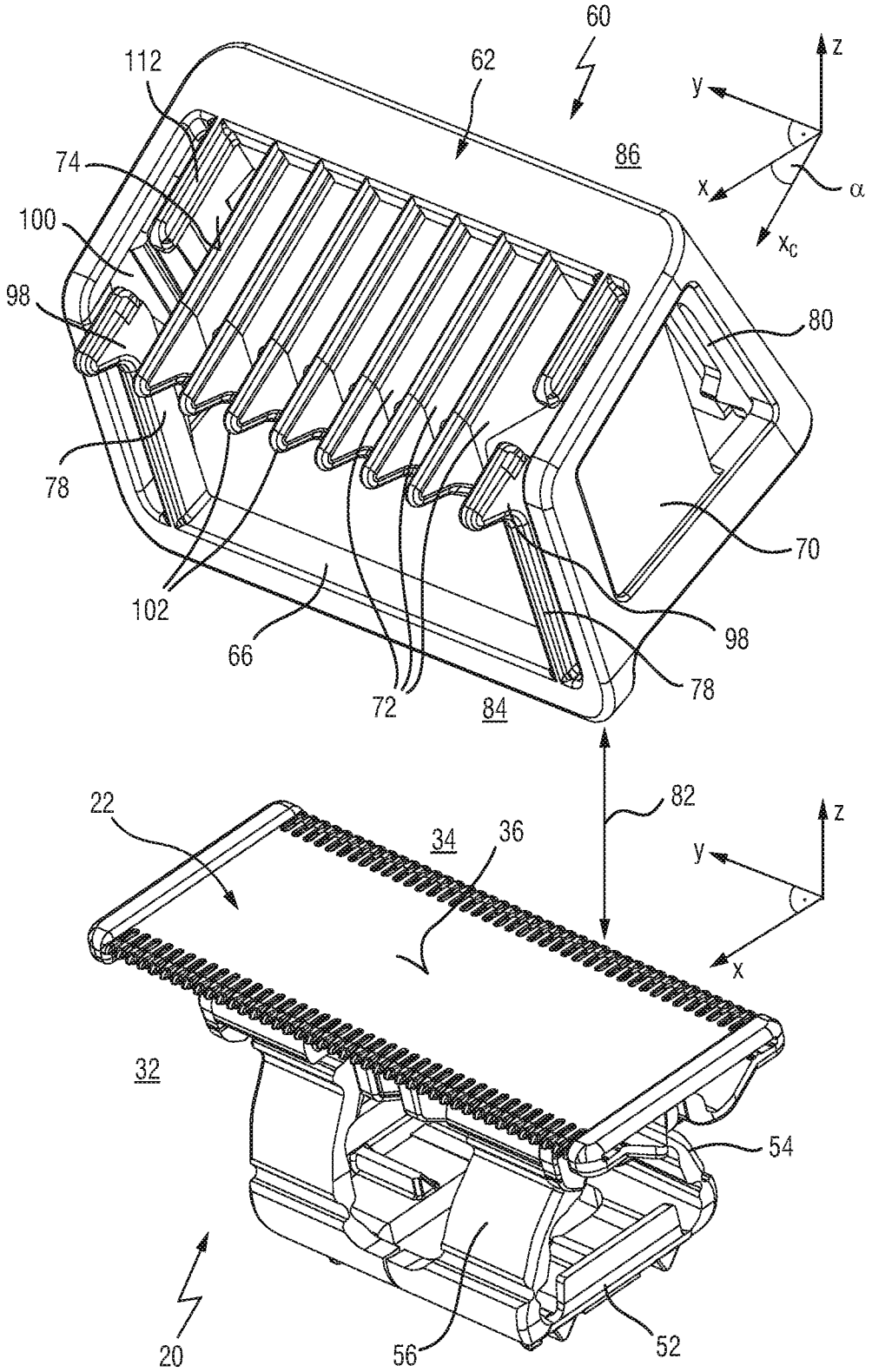
FIG. 5 is an enlarged perspective view of a blade set and an attachment comb that may be mounted thereto, wherein the attachment comb is shown in a detached state.
Figure 6:
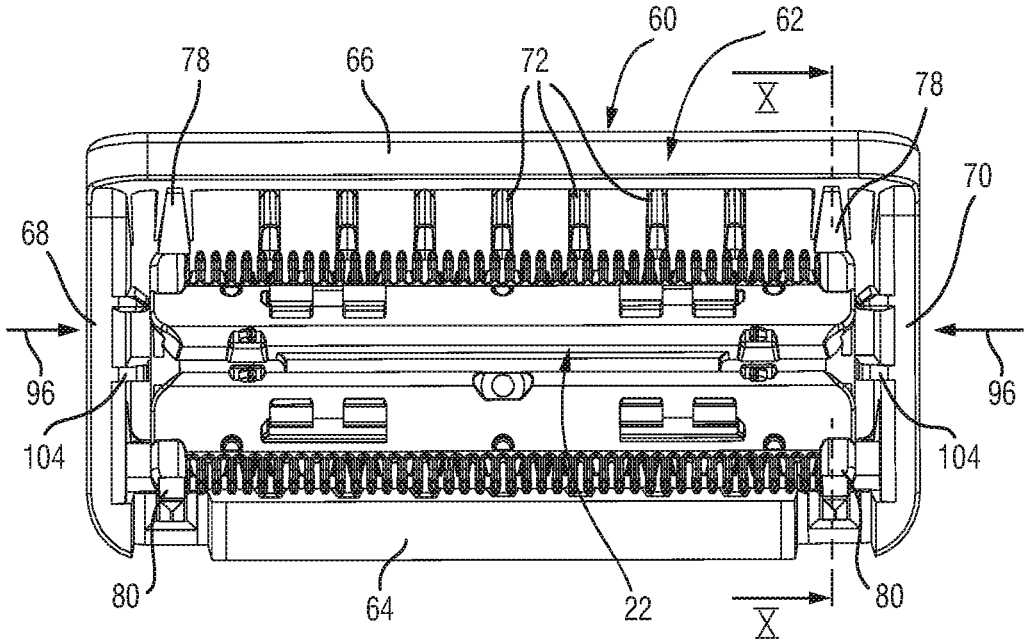
FIG. 6 is a bottom view of the attachment comb as shown in FIG. 5, wherein the attachment comb engages a blade set.
Figure 7:
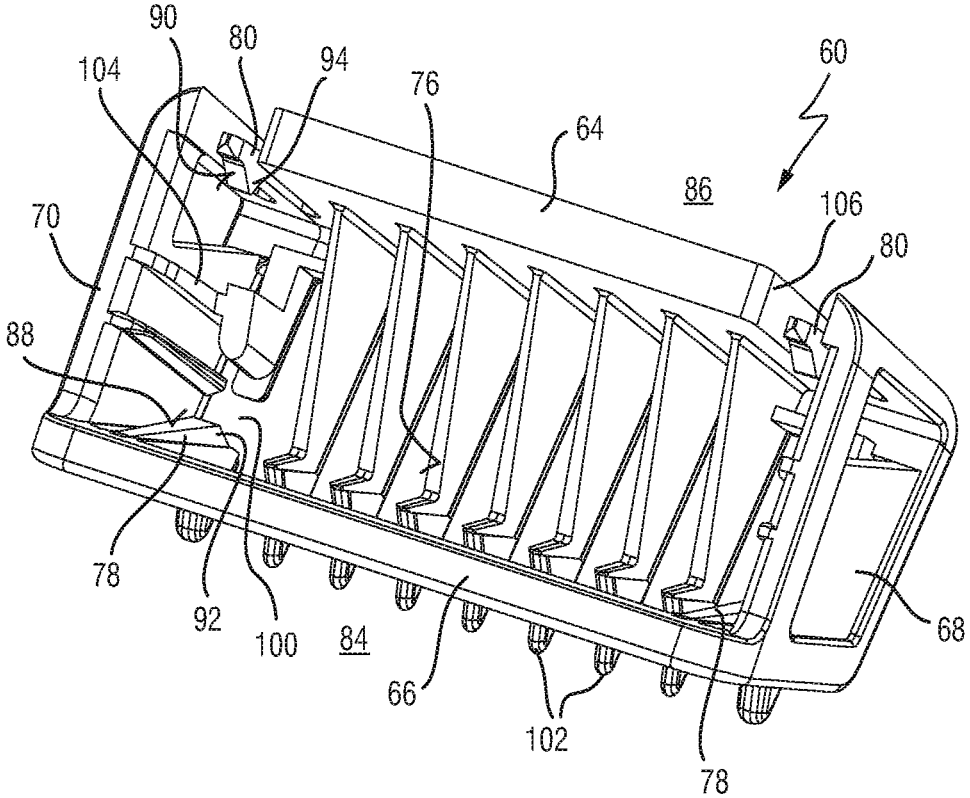
FIG. 7 shows a further perspective bottom view of the attachment comb as shown in FIG. 5, wherein the attachment comb is shown in isolation.

Further reference is made to FIGS. 5 to 7. As can be seen from the perspective top view of FIG. 5 and from the perspective rear or bottom view of FIG. 7, the attachment comb 60 of this embodiment comprises a supporting frame 62 that comprises a first supporting bar 64 and a second supporting bar 66. Preferably, the supporting bar 64 and the supporting bar 66 are displaced from each other in a basically parallel fashion. The supporting bar 64 may be referred to as distal, rear or rearward supporting bar 64. The supporting bar 66 may be referred to as proximal, frontal supporting bar 66. The supporting bar 66 is arranged at the longitudinal side of the attachment comb 60 that, when in operation, would basically first contact the to-be-processed skin.

At respective lateral sides of the supporting frame 62, a first lateral grip bar 68 and a second lateral grip bar 70 are provided. The supporting bars 64, 66 extend from the lateral grip bar 68 to the lateral grip bar 70. The lateral grip bars 68, 70 basically extend in the longitudinal direction X and/or in a plane that is defined by the longitudinal direction X and the vertical direction Z. The supporting bars 64, 66 basically extend in the lateral direction Y. The supporting bars 64, 66 and the lateral grip bars 68, 70 jointly define the supporting frame 62 of the attachment comb 60. The supporting bars 64, 66 are, in the mounted state, arranged basically parallel to the lateral extension of the toothed leading edges 32, 34.

Figure 9:
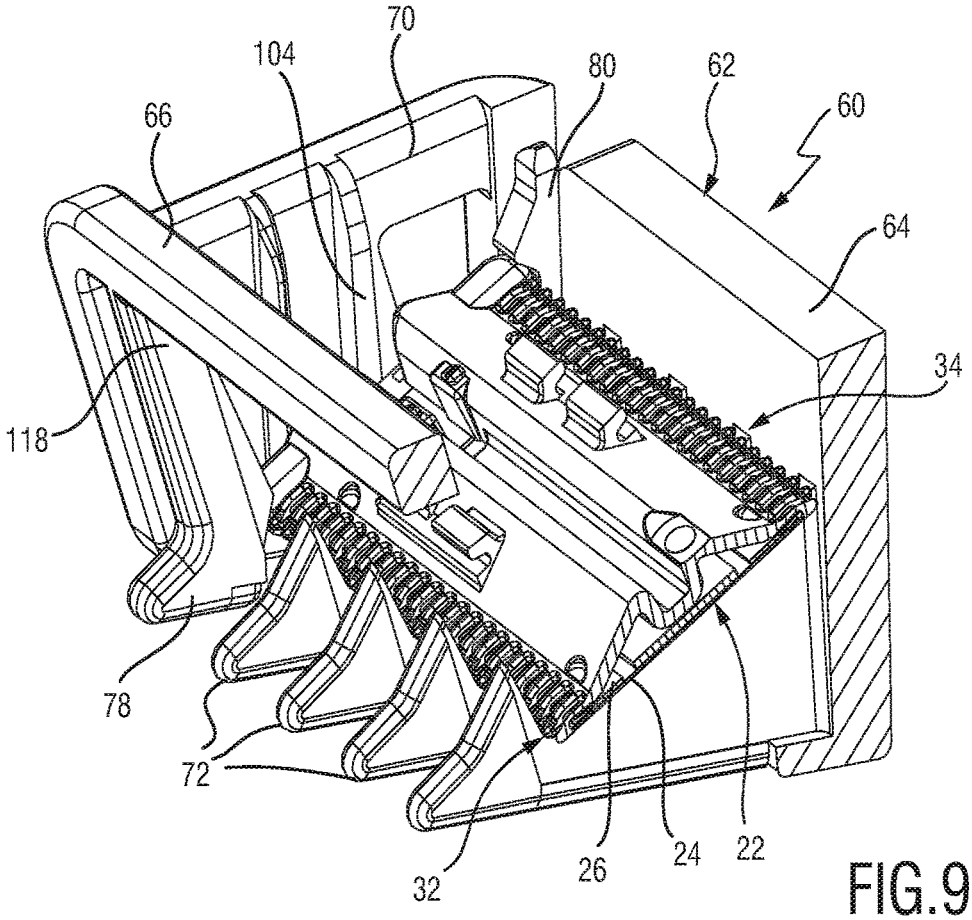
FIG. 9 shows a perspective cross-sectional bottom view of the arrangement shown in FIG. 6.
Figure 10:
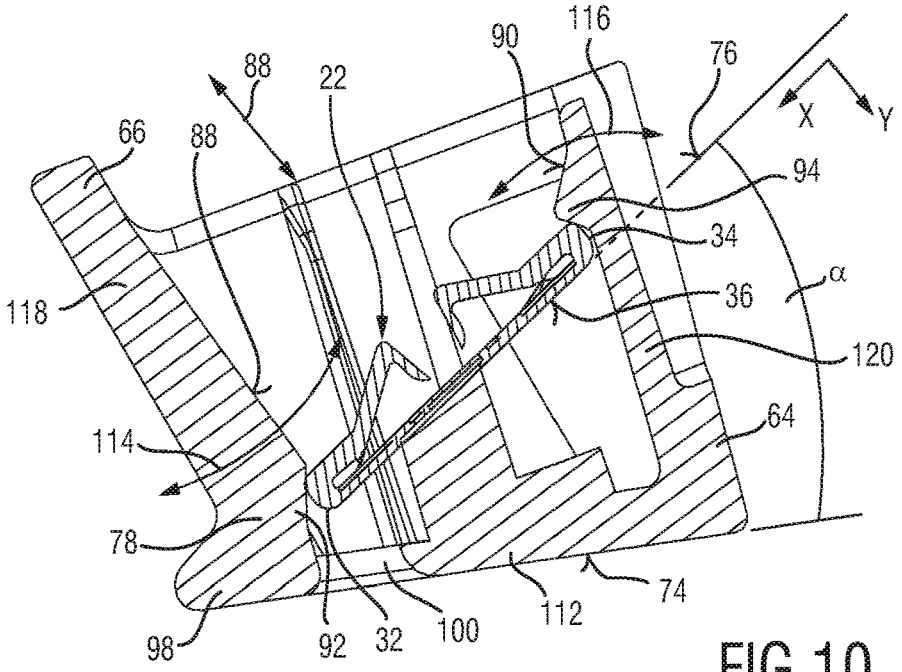
FIG. 10 shows a cross-sectional lateral side view of the arrangement of FIG. 6 taken along the lines X-X in FIG. 6.
Figure 11:
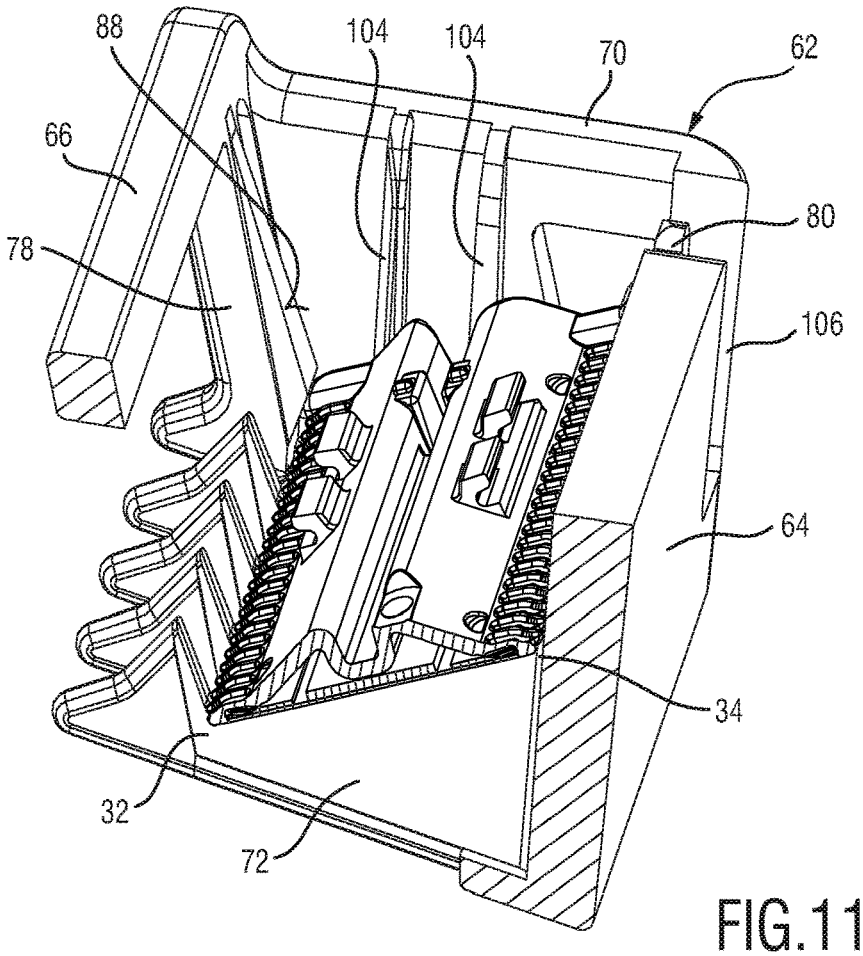
FIG. 11 shows yet another perspective cross-sectional bottom view of the arrangement shown in FIG. 6, wherein the orientation of the view of FIG. 11 is slightly different from the orientation of the view of FIG. 9.

As can be best seen from FIGS. 9, 10 and 11, the supporting bar 64 covers the toothed leading edge 34. As a consequence, the toothed edge 34 is somewhat blocked or deactivated in the mounted state of the attachment comb 60. Conversely, the supporting bar 66 is associated with the toothed leading edge 32 but spaced away from the toothed leading edge 32 in a basically parallel fashion thereto. Preferably, the attachment comb 60 is arranged as a dual-side attachment comb 60. This may involve that the attachment comb 60 may be reversely attached to the blade set 20. As a consequence, in a reverse mounted state, the supporting bar 66 would be associated with and cover the toothed leading edge 32, wherein the supporting bar 64 would be associated with and arranged at a distance from the toothed leading edge 34 in a basically parallel fashion thereto.

In the exemplary embodiment illustrated in FIGS. 3 to 11, the supporting frame 62 as defined by the supporting bar 64, 66 and the lateral grip bars 68, 70 is arranged as a closed surrounding supporting frame 62. However, at least in some embodiments, the supporting frame 62 may be arranged as an open profile or frame, wherein for instance the supporting bar 66 is omitted or, for instance, interrupted. However, it is preferred that both the supporting 64 and the supporting bar 66 connect the lateral grip bar 68 and the lateral grip bar 70. This may have the advantage that a respective push force that is applicable by the user to the lateral grip bars 68, 70 may not significantly deform the attachment comb 60, and, as a consequence, bias the blade set 22. A main direction of the push force that is typically applied by the user to the lateral grip bars 68, 70 is indicated in FIG. 6 by arrows 96 that are basically parallel to the lateral direction Y.

Preferably, the first lateral grip bar 68 and the second lateral grip bar 70 are provided with a respective indication that prompts the user to grasp and engage the attachment comb 60. Typically, the users themselves would tend to contact the lateral grip bars 68, 70 of the attachment comb 60 so as to avoid contacting the (laterally extending) supporting bars 64, 66 which might induce a load on the leading edges 32, 34. This is mainly because applying a push force to the supporting bars 64, 66 would quite likely cause an excessive biasing force on the toothed leading edges 32, 34 of the blade set 22. By way of example, each of the lateral grip bars 68, 70 may be provided with a respective depression or recess to indicate the intended force application spots.

The attachment comb 60 further comprises a plurality of guide teeth 72 that extend from the supporting bar 64 of the supporting frame 62. The guide teeth 72 are basically oriented in a defined pattern or series with respect to the teeth 38 of the stationary blade 24. The guide teeth 72 basically extend in the longitudinal direction X or, more generally, in a plane that is defined by the longitudinal direction X and the vertical direction Z. At a top side or front side of the attachment comb 60 that typically contacts the skin in the mounted state when the hair cutting appliance 10 is in operation, the guide teeth 72 jointly define a skin contact face 74, refer also to FIG. 5 and to FIG. 10.

As can be further seen from FIG. 5, the skin contact face 74 may define a plane that, on the one hand, is basically parallel to the lateral direction Y. On the other hand, the skin contact face 74 may be arranged at an angle α (alpha) with respect to the longitudinal direction X. As a consequence, the skin contact face 74 may define a tilted longitudinal direction $X_c$ of the attachment comb 60. In other words, the skin contact face 74 and the top face or front face 36 of the blade set 22 are arranged at an angle α in the mounted state. At a rear side or back side, the guide teeth 72 define a receiving seat 76 that contacts the top face 36 in the mounted state. In other words, also the skin contact face 74 and the receiving seat 76 are arranged at an angle α.

So as to attach the attachment comb 60 to the blade set 22, particularly to relatively rigid reinforced lateral end portions thereof, a plurality of snap-on elements 78, 80 is provided at the attachment comb 60. Generally, the snap-on elements 78, 80 may be referred to as snap-on mounting elements. Particularly, respective pairs, preferably two pairs of proximal snap-on elements 78 and distal snap-on elements 80 may be provided. A first pair of snap-on elements 78, 80 may be associated with the first lateral grip bar 68. A second pair of snap-on elements 78, 80 may be associated with the second lateral grip bar 70. However, preferably the snap-on elements 78, 80 are not directly attached to the respective lateral grip bars 68, 70. Rather, the proximal snap-on elements 78 are arranged at a first, proximal side 84 of the attachment comb 60 and may extend from the (proximal) supporting bar 66. Further, the distal snap-on elements 80 are arranged on a second, distal side 86 of the attachment comb 60 and may extend from the (distal) supporting bar 64.

A defined general mounting direction (and removal direction) is indicated in FIG. 5 by a double arrow 82. Preferably, the user grasps the attachment comb 60 at the lateral grip bars 68, 70, and generally positions and orients the attachment comb 60 in a fashion as shown in FIG. 5 and, eventually, approaches the blade set 22 in the mounting direction 82. This has the advantage that the user does not have to directly actuate the snap-on elements 78, 80. Rather, the snap-on elements 78, 80 are mediately actuated and deflected when detachment comb 60 contacts and engages the blade set 22.

Further reference is made to FIGS. 7 to 11 showing the snap-on elements 78, 80 in more detail. So as to facilitate the engagement of the blade set 22 and the attachment comb 60, the proximal snap-on elements 78 are provided with an insertion ramp 88 and the distal snap-on elements 80 are provided with an insertion ramp 90. The insertion ramps 88, 90 define a tapered funnel-like geometry that facilitates the mounting process. Adjacent to the ramp 88 of the proximal snap-on elements 78, a retaining portion 92 is provided. Adjacent to the ramps 90 of the distal snap-on elements 80, a retaining portion 94 is provided. As can be best seen from FIG. 10, the retaining portions 92, 94 may inwardly protrude from the snap-on elements 78, 80 and may define a bottleneck or a constriction.

In the mounted state, as illustrated in FIGS. 9 to 11, the retaining portions 92, 94 may retain and secure the attachment comb 60 in the desired position and orientation at the blade set 22. A biasing force that may be attributed to a mounting deflection of the snap-on elements 78, 80 may basically act in the longitudinal direction X on the blade set 22. Apart from that, it is preferred that no biasing force or only a considerably small biasing force acts in the lateral direction Y on the blade set 22, even though the push-force applied by the user to the lateral grip bars 68, 70 is applied in the lateral direction Y, refer to the arrows 96 in FIG. 6

Reference is again made to FIG. 5. As with the embodiment of FIG. 5, the proximal snap-on elements 78 may be formed at respective mounting teeth 98 that may form lateral end teeth of the attachment comb 60. So as to provide the snap-on elements 78 with the desired deflecting capability, the mounting teeth 98 may be interrupted or, more generally, provided with a weakening recess 100. Apart from that, also the mounting teeth 98 may contribute to the formation of the skin contact face 74 and/or the receiving seat 76. A rear portion of the mounting teeth 98 is indicated in FIG. 5 by reference numeral 112. The rear portion 112 extends from the distal supporting bar 64. The rear portion 112 of the mounting teeth 98 is considerably stiff and rigid. By contrast, the proximal snap-on elements 98 that form a frontal portion of the mounting teeth 98 are arranged in a considerably deflectable fashion. The recess or interruption between the proximal snap-on elements 78 and the rear portion 112 at the mounting teeth 98 is indicated in FIGS. 5 and 7 by reference numeral 100. As can be further seen from FIG. 5, the guide teeth 72, and also the mounting teeth 98 may be provided with rounded tips 102 that are arranged to contact the skin.

As can be further seen from the bottom view of FIG. 6, and from the perspective bottom view of FIG. 7, lateral guide ribs 104 may inwardly extend from the lateral grip bars 68, 70. Preferably, the lateral guide rips 104 merely define a lateral position of the attachment comb 60 in the mounted state with respect to the blade set 22. However, the lateral guide rips 104 are not provided with engagement features, locking features or biasing features that are arranged to apply a force in the lateral direction Y onto the blade set 22. It is preferred that the lateral guide rips 104 are sufficiently spaced or offset from the lateral ends of the blade set 22 in the mounted state such that even a considerably increased level of a user's push force (reference numeral 96 in FIG. 6) does not directly influence or bias the blade set 22 in the lateral direction Y.

Figure 8:
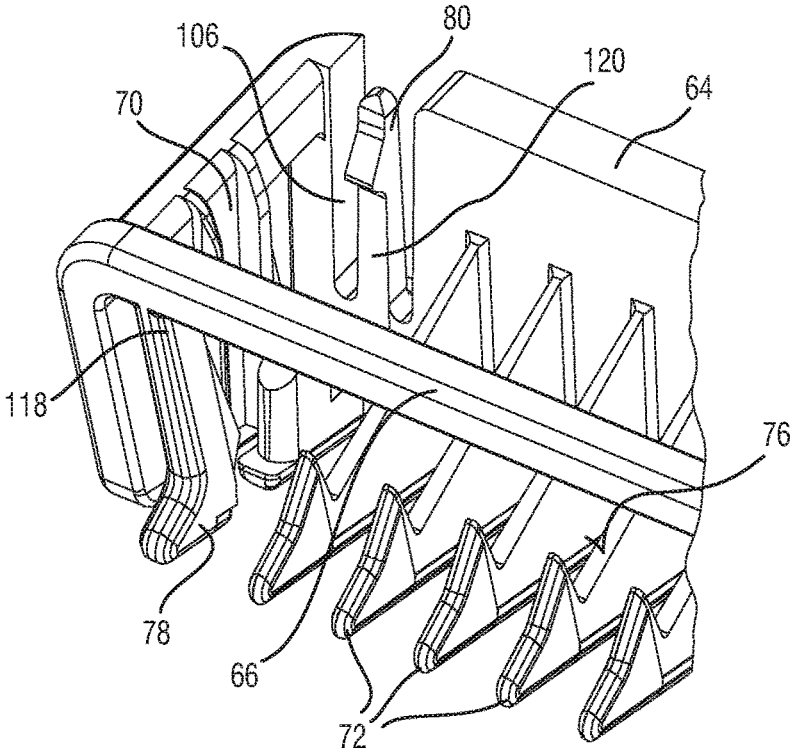
FIG. 8 shows yet another detailed partial perspective bottom view of the attachment comb as shown in FIG. 7.

As can be best seen from FIG. 7 and from FIG. 8, the distal snap-on elements 80 are arranged in a recess or slot 106 that is provided at the distal supporting bar 64. As a consequence, the distal snap-on elements 80 may be sufficiently deflectable so as to engage and retain the blade set 22 in cooperation with the opposite proximal snap-on elements 78.

Further reference is made to FIGS. 8, 9 and 10. An engagement deflection of the proximal snap-on elements 78 is indicated in FIG. 10 by a curved double-arrow that is designated by reference numeral 114. An engagement deflection of the distal snap-on elements 80 is indicated in FIG. 10 by a curved double-arrow that is designated by reference numeral 116. As can be further seen, the proximal snap-on elements 78 are attached to the proximal supporting bar 66 at a bottom side (shifted away from the skin) of a plane that is defined by the longitudinal direction X and the lateral direction Y that is opposite to a top or front side where the distal snap-on elements 80 are attached to the distal supporting bar 64. In other words, respective deflection zones or hinge portions 118, 120 of the snap-on elements 78, 80 may be arranged at opposite sides with respect to the afore-mentioned plane X-Y.

The hinge portion 118 may be formed by a transition between the proximal snap-on elements 78 and the proximal supporting bar 66. The hinge portion 120 may be arranged at a transition between the distal snap-on elements 80 and the distal supporting bar 64. The hinge portions 118, 120 may be referred to as deflection zones. It goes without saying that the hinge portions 118, 120 do not necessarily have to be explicitly formed and shaped at the respective transition between the snap-on elements 78, 80 and the supporting bars 64, 66. Rather, an inherent flexibility of the snap-on elements 78, 80 or, more particularly, of the plastic material the attachment comb 60 is made from, may enable the required deflecting functionality.

It goes without saying that the attachment comb 80 may be reversely and repeatedly attached to and removed from the blade set 22 of the hair cutting appliance 10. Hence, in the reversed mounted state, the proximal snap-on elements 78 may engage the second leading edge 34, and the distal snap-on elements 80 may engage the first leading edge 32.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

What is claimed is:

1. A releasable attachment comb comprising: a supporting frame comprising: a first lateral frame, said first lateral frame comprising a first lateral grip bar; a second lateral frame, said second lateral frame comprising a second lateral grip bar, said first lateral frame and said second lateral frame being on opposite lateral sides of said supporting frame; and a first supporting planar element extending between said first lateral frame and said second lateral frame, said first supporting planar element forming a distal surface of said supporting frame, said first supporting planar element comprising: a plurality of teeth extending from a top edge said first supporting planar element, said plurality of teeth forming a top surface of said supporting frame; and a plurality of distal retaining elements extending from said top edge, wherein one of said plurality of distal retaining elements is positioned proximate said first lateral frame and one of said plurality of distal retaining element is positioned proximate said second lateral frame, wherein each of said plurality of distal retaining elements is configured to deflect; a second planar element extending between said first lateral frame and said second lateral frame, said second planar element bar defining a proximal plane of said attachment comb, said second planar element comprising: a plurality of proximal retaining elements within said proximal plane, each of said plurality of proximal retaining elements, is configured to: deflect when contacted by a blade set to allow entry of a blade set into said supporting frame; and lock said blade set between said plurality of distal retaining elements and said plurality of proximal retaining elements.

2. The attachment comb as claimed in claim 1, wherein one of said plurality of proximal retaining elements is positioned proximate said first lateral frame and one of said plurality of proximal retaining elements is positioned proximate said second lateral frame.

3. The attachment comb as claimed in claim 1, wherein a free end of said one of said plurality of proximal retaining element proximate said first lateral frame forming a first tooth element in line with said plurality of teeth and a free end of said one of said plurality of proximal retaining elements proximal said second lateral frame forming a second tooth element in line with said plurality of teeth.

4. The attachment comb as claimed in claim 1, wherein said plurality of distal retaining elements are configured to:

deflect outwardly from said attachment comb, when said plurality of distal retaining elements contacts said blade set.

5. The attachment comb as claimed in claim 1, wherein each of said plurality of distal retaining elements comprises: a distal insertion ramp, wherein said distal insertion ramp: progressively increases a thickness of a corresponding one of said plurality of distal retaining elements, wherein said increased thickness reduces a distance between a distal plane defined by the plurality of distal retaining elements and said proximal plane.

6. The attachment comb as claimed in claim 5, wherein said distal insertion ramp comprises:

a distal retaining portion, said first distal portion configured to:

retain said blade set to said attachment comb.

7. The attachment comb as claimed in claim 1, wherein said plurality of proximal retaining element are configured to:

deflect outwardly from said attachment comb when said plurality of proximal retaining elements contact said blade set.

8. The attachment comb as claimed in claim 1, wherein each of said plurality of proximal retaining elements comprises: a proximal insertion ramp, wherein said proximal insertion ramp progressively increases a thickness of a corresponding one of said plurality of proximal retaining elements, wherein said increased thickness reduces a distance between a distal plane defined by the plurality of distal retaining elements and said proximal plane.

9. The attachment comb as claimed in claim 8, wherein said proximal insertion ramp comprises:

a proximal retaining portion, said proximal retaining portion configured to:

retain said blade set to said attachment comb.

10. The attachment comb as claimed in claim 1, wherein each of said first lateral frame and said second lateral frame comprises:

a lateral grip.

11. A hair cutting appliance comprising: a housing comprising: a motor; a blade set comprising: a stationary blade; and a cutter blade, wherein said motor is configured to: drive said cutter blade; and an attachment comb configured to: retain said blade set within said attachment comb; and position said hair cutting appliance a known distance from a user of said hair cutting appliance, wherein said attachment comb comprises: a first lateral surface; a second lateral surface separated from and parallel to said first later surface; and a planar element attached to said first lateral surface and to said second lateral surface, said planar element forming a first side of said attachment comb, wherein said planar element comprises: a first distal mounting element positioned proximate said first lateral surface; and a second distal mounting element positioned proximate said second lateral surface, wherein said first distal mounting element and said second distal mounting element extend from a top edge of said planar element toward a bottom edge of said planar element; a plurality of teeth elements extending from a top surface of said planar element toward a proximal surface of said attachment comb; and a proximal support bar extending from said first lateral surface to said second lateral surface, said proximal support bar contained within said proximate surface of said attachment comb, wherein said proximal support bar comprises: a first proximal mounting element positioned proximate said first lateral surface, and a second proximal mounting element positioned proximate said second lateral surface, wherein each of said first distal mounting element, said second distal mounting element, said first proximal mounting element and said second proximal mounting element is configured to: deflect outwardly from said attachment comb.

12. The hair cutting appliance as claimed in claim 11, wherein each of said first distal mounting element and said second distal mounting element comprises: a distal insertion ramp extending from a free end toward said top edge of said planar element, wherein said distal insertion ramp progressively increases a thickness of said each distal mounting element to a known maximum thickness; and progressively decreases said thickness of said each distal mounting element from said known maximum thickness, wherein said distal insertion ramp is configured to: cause said outward deflection of said each distal mounting element when contacted by said blade set; and retain said blade set when said blade set extends along said distal insertion ramp past said known maximum thickness.

13. The hair cutting appliance as claimed in claim 11, wherein each of said first proximal mounting element and said second proximal mounting element comprises: a proximal insertion ramp extending from said proximal support bar to said top surface of said attachment comb, wherein said proximal insertion ramp progressively increases a thickness of said each proximal mounting element, wherein said proximal insertion ramp is configured to: cause said outward deflection of said each proximal mounting element.

14. The hair cutting appliance as claimed in claim 11, wherein a free end of said first proximal mounting element forming a first tooth element proximate said first lateral surface and in line with said plurality of teeth in said top surface of said attachment comb and a free end of said second proximal mounting element forming a second tooth element proximate said second lateral surface and in line with said plurality of teeth in said top surface of said attachment comb.

15. The hair cutting appliance as claimed in claim 11, wherein each of said first lateral side and said second lateral side comprising:

at least one lateral guide rib extending into said attachment comb.

16. The hair cutting appliance as claimed in claim 11, wherein the blade set is releasably attached to said housing.

17. A releasable attachment comb configured to attach to a blade set, said attachment comb comprising: a distal planar element; a first lateral surface extending substantially perpendicular to a first edge of said distal planar element; a second lateral surface extending substantially perpendicular to a second edge of said distal planar element; and a proximal support bar extending between said first lateral surface and said second lateral surface, said proximal support bar forming a lower edge of a proximal plane of said attachment comb, wherein said distal planar element comprises: a plurality of guide teeth extending from said distal planar element toward said proximal plane, said plurality of guide teeth forming a top surface of said attachment comb; a plurality of distal mounting elements extending from a top edge of said distal planar element within said distal planar element, wherein one of said plurality of distal mounting elements is proximate said first lateral surface and one of said plurality of distal mounting elements is proximate said second lateral surface, and said proximal support bar comprises: a plurality of proximal mounting elements attached on a first end to said support bar, wherein one of said plurality of proximal mounting elements is proximate said first lateral surface and one of said plurality of proximal mounting elements is proximate said second lateral surface, wherein at least one of the plurality of proximal mounting elements and the plurality of distal mounting element is configured to: deflect outwardly as said blade set contacts a corresponding at least one of said plurality of proximal mounting elements and said plurality of distal mounting elements.

18. The releasable attachment comb of claim 17, wherein each of said proximal mounting elements and said distal mounting elements comprises:

an insertion ramp, wherein said insertion ramp comprises:

an expansion section progressively increasing a thickness of a corresponding mounting element from a free end said corresponding mounting element, and a retainer section progressively decreasing said thickness of said corresponding mounting element, wherein said insertion ramp is configured to:

deflect outwardly as said blade set contacts said expansion section; and deflect inwardly as said blade set contacts said retainer section.

19. The releasable attachment comb of claim 17, wherein said distal mounting element are opposite said proximal mounting elements.

20. The releasable attachment comb of claim 18, wherein said insertion ramp decreases a distance between said distal planar element and said proximal plane.

* * * * *